US010280479B2

(12) United States Patent
Yu et al.

(10) Patent No.: US 10,280,479 B2
(45) Date of Patent: May 7, 2019

(54) EARTH-BORING TOOLS AND METHODS FOR FORMING EARTH-BORING TOOLS USING SHAPE MEMORY MATERIALS

(71) Applicant: Baker Hughes Incorporated, Houston, TX (US)

(72) Inventors: Bo Yu, Spring, TX (US); Xu Huang, Spring, TX (US); Juan Miguel Bilen, The Woodlands, TX (US); John H. Stevens, The Woodlands, TX (US); Eric C. Sullivan, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 503 days.

(21) Appl. No.: 15/002,211

(22) Filed: Jan. 20, 2016

(65) Prior Publication Data

US 2017/0204672 A1 Jul. 20, 2017

(51) Int. Cl.
*E21B 10/567* (2006.01)
*C21D 10/00* (2006.01)
*C22F 1/00* (2006.01)

(52) U.S. Cl.
CPC ..... *C21D 10/00* (2013.01); *C22F 1/006* (2013.01); *E21B 10/567* (2013.01); (Continued)

(58) Field of Classification Search
CPC ... E21B 10/567; C21D 10/00; C21D 2201/02; C22F 1/006
See application file for complete search history.

(56) References Cited

U.S. PATENT DOCUMENTS 3,900,939 A 8/1975 Greacen
4,281,841 A 8/1981 Kim et al.
(Continued)

FOREIGN PATENT DOCUMENTS

JP 10068284 A 3/1998
WO 2014055089 A1 4/2014
(Continued)

OTHER PUBLICATIONS

International Search Report for International Application No. PCT/US2017/013758 dated Apr. 27, 2017, 3 pages.
(Continued)

*Primary Examiner* — Matthew R Buck
(74) *Attorney, Agent, or Firm* — TraskBritt

(57) ABSTRACT

An earth-boring tool includes a tool body, at least one cutting element, and a retaining member comprising a shape memory material (e.g., alloy, polymer, etc.) located between a surface of the tool body and a surface of the cutting element. The shape memory material is configured to transform, responsive to application of a stimulus, from a first solid phase to a second solid phase. The retaining member comprises the shape memory material in the second solid phase, and at least partially retains the at least one cutting element adjacent the tool body. The shape memory material may be trained in a first phase to a first shape, and trained in a second phase to a second shape. The retaining member may be at least partially within a cavity in the first phase, then transformed to the second phase to apply a force securing the cutting element to the tool body.

20 Claims, 7 Drawing Sheets

(52) U.S. Cl.
CPC .... *C21D 2201/01* (2013.01); *C21D 2211/001* (2013.01); *C21D 2211/008* (2013.01)

(56) References Cited

U.S. PATENT DOCUMENTS 4,582,149 A 4/1986 Slaughter, Jr.
4,597,632 A 7/1986 Mallinson
4,619,320 A 10/1986 Adnyana et al.
4,637,436 A 1/1987 Stewart et al.
4,700,790 A 10/1987 Shirley
4,743,079 A 5/1988 Bloch
4,754,538 A 7/1988 Stewart et al.
4,776,412 A 10/1988 Thompson
4,794,995 A 1/1989 Matson et al.
4,840,346 A 6/1989 Adnyana et al.
5,040,283 A 8/1991 Pelgrom
5,199,497 A 4/1993 Ross
5,380,068 A 1/1995 Raghavan
5,395,193 A 3/1995 Krumme et al.
5,494,124 A 2/1996 Dove et al.
5,507,826 A 4/1996 Besselink et al.
5,536,126 A 7/1996 Gross
5,632,349 A 5/1997 Dove et al.
5,653,298 A 8/1997 Dove et al.
5,662,362 A 9/1997 Kapgan et al.
5,678,645 A * 10/1997 Tibbitts ..... E21B 10/5673 175/426
5,718,531 A 2/1998 Mutschler, Jr. et al.
5,722,709 A 3/1998 Lortz et al.
5,858,020 A 1/1999 Johnson et al.
5,906,245 A * 5/1999 Tibbitts ..... E21B 10/5673 175/426
6,062,315 A 5/2000 Reinhardt
6,209,664 B1 4/2001 Amaudric du Chaffaut
6,311,793 B1 11/2001 Larsen et al.
6,321,845 B1 11/2001 Deaton
6,388,043 B1 5/2002 Langer et al.
6,433,991 B1 8/2002 Deaton et al.
6,484,822 B2 11/2002 Watson et al.
6,484,825 B2 11/2002 Watson et al.
6,732,817 B2 5/2004 Dewey et al.
6,742,585 B1 6/2004 Braithwaite et al.
6,749,376 B2 6/2004 Keefe et al.
6,779,602 B1 8/2004 Van Bilderbeek et al.
6,786,557 B2 9/2004 Montgomery, Jr.
6,880,650 B2 4/2005 Hoffmaster et al.
6,971,459 B2 12/2005 Raney
7,201,237 B2 4/2007 Raney
7,270,188 B2 9/2007 Cook et al.
7,275,601 B2 10/2007 Cook et al.
7,299,881 B2 11/2007 Cook et al.
7,314,099 B2 1/2008 Dewey et al.
7,357,190 B2 4/2008 Cook et al.
7,392,857 B1 7/2008 Hall et al.
7,419,016 B2 9/2008 Hall et al.
7,424,922 B2 9/2008 Hall et al.
7,451,836 B2 11/2008 Hoffmaster et al.
7,451,837 B2 11/2008 Hoffmaster et al.
7,493,971 B2 2/2009 Nevlud et al.
7,533,737 B2 5/2009 Hall et al.
7,571,780 B2 8/2009 Hall et al.
7,594,552 B2 9/2009 Radford et al.
7,641,002 B2 1/2010 Hall et al.
7,661,490 B2 2/2010 Raney
7,721,823 B2 5/2010 Radford
7,730,975 B2 6/2010 Hall et al.
7,845,430 B2 12/2010 Johnson et al.
7,849,939 B2 12/2010 Downton et al.
7,882,905 B2 2/2011 Radford et al.
7,954,568 B2 6/2011 Bilen
7,971,661 B2 7/2011 Johnson et al.
7,971,662 B2 7/2011 Beuershausen
8,011,456 B2 9/2011 Sherwood, Jr.
8,087,479 B2 1/2012 Kulkarni et al.
8,141,665 B2 3/2012 Ganz
8,201,648 B2 6/2012 Choe et al.
8,205,686 B2 6/2012 Beuershausen
8,205,689 B2 6/2012 Radford
8,225,478 B2 7/2012 Kane
8,240,399 B2 8/2012 Kulkarni et al.
8,281,882 B2 10/2012 Hall et al.
8,302,703 B2 11/2012 Rolovic
8,376,065 B2 2/2013 Teodorescu et al.
8,381,844 B2 2/2013 Matthews, III et al.
8,388,292 B2 3/2013 Kirkwood et al.
8,453,763 B2 6/2013 Radford et al.
8,496,076 B2 7/2013 DiGiovanni et al.
8,511,946 B2 8/2013 Woodruff et al.
8,534,384 B2 9/2013 Beuershausen et al.
8,579,052 B2 11/2013 DiGiovanni et al.
8,727,042 B2 5/2014 DiGiovanni
8,727,043 B2 * 5/2014 Zhang ..... E21B 10/573 175/413
8,746,368 B2 6/2014 Johnson et al.
8,763,726 B2 7/2014 Johnson et al.
8,813,871 B2 8/2014 Radford et al.
8,950,517 B2 2/2015 Hall et al.
8,960,329 B2 2/2015 Downton
8,997,897 B2 * 4/2015 De Reynal ..... B24D 18/0009 175/374
9,080,399 B2 7/2015 Oesterberg
9,091,132 B1 7/2015 Cooley et al.
9,103,175 B2 8/2015 Schwefe
9,140,074 B2 9/2015 Schwefe et al.
9,180,525 B2 11/2015 Park et al.
9,181,756 B2 11/2015 Schwefe et al.
9,187,960 B2 11/2015 Radford et al.
9,255,449 B2 2/2016 Schwefe et al.
9,255,450 B2 2/2016 Jain et al.
9,267,329 B2 2/2016 Bilen
9,279,293 B2 3/2016 Izbinski
9,359,826 B2 6/2016 Do et al.
9,399,892 B2 7/2016 Do et al.
9,422,964 B2 8/2016 Rule et al.
9,611,697 B2 4/2017 Radford et al.
9,663,995 B2 5/2017 Jain
9,677,344 B2 6/2017 Radford et al.
9,708,859 B2 7/2017 Jain et al.
9,759,014 B2 9/2017 Do et al.
9,915,138 B2 3/2018 Schwefe et al.
9,932,780 B2 4/2018 Spencer et al.
9,970,239 B2 5/2018 Oesterberg
10,000,977 B2 6/2018 Jain et al.
10,001,005 B2 6/2018 Schwefe et al.
10,041,305 B2 8/2018 Jain
2002/0062547 A1 5/2002 Chiodo et al.
2004/0069540 A1 4/2004 Kriesels et al.
2004/0155125 A1 8/2004 Kramer et al.
2004/0194970 A1 10/2004 Eatwell et al.
2006/0019510 A1 1/2006 Rudduck et al.
2006/0048936 A1 3/2006 Fripp et al.
2006/0266557 A1 11/2006 Estes
2007/0227775 A1 10/2007 Ma et al.
2008/0236899 A1 10/2008 Oxford et al.
2009/0133931 A1 5/2009 Rolovic
2009/0139727 A1 6/2009 Tanju et al.
2009/0205833 A1 8/2009 Bunnell et al.
2009/0321145 A1 12/2009 Fisher et al.
2010/0038141 A1 2/2010 Johnson et al.
2010/0071956 A1 3/2010 Beuershausen
2010/0132957 A1 6/2010 Joseph et al.
2010/0187018 A1 7/2010 Choe et al.
2010/0314176 A1 12/2010 Zhang et al.
2011/0031025 A1 2/2011 Kulkarni et al.
2011/0146265 A1 6/2011 Joseph et al.
2011/0155473 A1 6/2011 Raney
2012/0255784 A1 10/2012 Hanford
2012/0312599 A1 12/2012 Trinh et al.
2013/0180784 A1 7/2013 Esko et al.
2014/0216827 A1 8/2014 Zhang et al.
2014/0374167 A1 12/2014 Mueller et al.
2015/0152723 A1 * 6/2015 Hay ..... E21B 47/01 175/17

(56) References Cited

U.S. PATENT DOCUMENTS

| | | | | |
|---|---|---|---|---|
| 2015/0218889 | A1* | 8/2015 | Carroll | E21B 10/25<br>175/371 |
| 2016/0138353 | A1 | 5/2016 | Ruttley et al. | |
| 2016/0258224 | A1 | 9/2016 | Do et al. | |
| 2017/0175455 | A1 | 6/2017 | Jain et al. | |
| 2017/0234071 | A1 | 8/2017 | Spatz et al. | |
| 2017/0335631 | A1 | 11/2017 | Eddison | |
| 2017/0362898 | A1 | 12/2017 | Do et al. | |
| 2018/0128060 | A1 | 5/2018 | Haugvaldstad | |
| 2018/0179826 | A9 | 6/2018 | Jain et al. | |

FOREIGN PATENT DOCUMENTS

| | | | |
|---|---|---|---|
| WO | 2015088508 | A1 | 6/2015 |
| WO | 2015195244 | A1 | 12/2015 |
| WO | 2016057076 | A1 | 4/2016 |
| WO | 2016/187372 | A1 | 11/2016 |
| WO | 2017/044763 | A1 | 3/2017 |
| WO | 2017/106605 | A1 | 6/2017 |
| WO | 2017/132033 | A1 | 8/2017 |
| WO | 2017/142815 | A1 | 8/2017 |

OTHER PUBLICATIONS

International Written Opinion for International Application No. PCT/US2017/013758 dated Apr. 27, 2017, 7 pages.

* cited by examiner

EARTH-BORING TOOLS AND METHODS FOR FORMING EARTH-BORING TOOLS USING SHAPE MEMORY MATERIALS

CROSS-REFERENCE TO RELATED APPLICATIONS

The subject matter of this application is related to the subject matter of U.S. patent application Ser. No. 15/002,230, "Earth-Boring Tools, Depth-of-Cut Limiters, and Methods of Forming or Servicing a Wellbore," and U.S. patent application Ser. No. 15/002,189, "Nozzle Assemblies Including Shape Memory Materials for Earth-Boring Tools and Related Method," each filed on even date herewith, the entire disclosure of each of which is hereby incorporated herein by this reference.

FIELD

Embodiments of the present disclosure relate generally to cutting elements, inserts, polycrystalline compacts, drill bits, and other earth-boring tools, and to methods of securing cutting elements, inserts, and polycrystalline compacts to bit bodies.

BACKGROUND

Cutting elements used in earth boring tools often include polycrystalline diamond compact (often referred to as "PDC") cutting elements, which are cutting elements that include cutting faces of a polycrystalline diamond material. Polycrystalline diamond (often referred to as "PCD") material is material that includes inter-bonded grains or crystals of diamond material. In other words, PCD material includes direct, intergranular bonds between the grains or crystals of diamond material.

PDC cutting elements are formed by sintering and bonding together relatively small diamond grains under conditions of high temperature and high pressure in the presence of a catalyst (for example, cobalt, iron, nickel, or alloys or mixtures thereof) to form a layer or "table" of polycrystalline diamond material on a cutting element substrate. These processes are often referred to as high-temperature/high-pressure (or "HTHP") processes. The cutting element substrate may include a cermet material (i.e., a ceramic-metal composite material) such as cobalt-cemented tungsten carbide. In such instances, the cobalt (or other catalyst material) in the cutting element substrate may diffuse into the diamond grains during sintering and serve as the catalyst for forming the intergranular diamond-to-diamond bonds, and the resulting diamond table, from the diamond grains. In other methods, powdered catalyst material may be mixed with the diamond grains prior to sintering the grains together in an HTHP process.

Upon formation of a diamond table using an HTHP process, catalyst material may remain in interstitial spaces between the grains of diamond in the resulting polycrystalline diamond table. The presence of the catalyst material in the diamond table may contribute to thermal damage in the diamond table when the cutting element is heated during use, due to friction at the contact point between the cutting element and the rock formation being cut.

PDC cutting elements in which the catalyst material remains in the diamond table are generally thermally stable up to a temperature of about 750° C., although internal stress within the cutting element may begin to develop at temperatures exceeding about 400° C. due to a phase change that occurs in cobalt at that temperature (a change from the "beta" phase to the "alpha" phase). Also beginning at about 400° C., an internal stress component arises due to differences in the thermal expansion of the diamond grains and the catalyst material at the grain boundaries. This difference in thermal expansion may result in relatively large tensile stresses at the interface between the diamond grains, and may contribute to thermal degradation of the microstructure when PDC cutting elements are used in service. Differences in the thermal expansion between the diamond table and the cutting element substrate to which it is bonded may further exacerbate the stresses in the polycrystalline diamond compact. This differential in thermal expansion may result in relatively large compressive and/or tensile stresses at the interface between the diamond table and the substrate that eventually leads to the deterioration of the diamond table, causes the diamond table to delaminate from the substrate, or results in the general ineffectiveness of the cutting element.

Furthermore, at temperatures at or above about 750° C., some of the diamond crystals within the diamond table may react with the catalyst material, causing the diamond crystals to undergo a chemical breakdown or conversion to another allotrope of carbon. For example, the diamond crystals may graphitize at the diamond crystal boundaries, which may substantially weaken the diamond table. Also, at extremely high temperatures, in addition to graphite, some of the diamond crystals may be converted to carbon monoxide or carbon dioxide.

In order to reduce the problems associated with differences in thermal expansion and chemical breakdown of the diamond crystals in PDC cutting elements, so called "thermally stable" polycrystalline diamond compacts (which are also known as thermally stable products, or "TSPs") have been developed. Such a TSP may be formed by leaching the catalyst material (e.g., cobalt) out from interstitial spaces between the inter-bonded diamond crystals in the diamond table using, for example, an acid or combination of acids (e.g., aqua regia). A substantial amount of the catalyst material may be removed from the diamond table, or catalyst material may be removed from only a portion thereof. TSPs in which substantially all catalyst material has been leached out from the diamond table have been reported to be thermally stable up to temperatures of about 1,200° C. It has also been reported, however, that such fully leached diamond tables are relatively more brittle and vulnerable to shear, compressive, and tensile stresses than are non-leached diamond tables. In addition, it may be difficult to secure a completely leached diamond table to a supporting substrate.

Cutting elements are typically mounted on a drill bit body by brazing. The drill bit body is formed with recesses therein for receiving a substantial portion of the cutting element in a manner which presents the PCD layer at an appropriate angle and direction for cutting in accordance with the drill bit design. In such cases, a brazing compound is applied to the surface of the backing and in the recess on the bit body in which the cutting element is received. The cutting elements are installed in their respective recesses in the bit body, and heat is applied to each cutting element via a torch to raise the temperature to a point which is high enough to braze the cutting elements to the bit body but not so high as to damage the PCD layer.

BRIEF SUMMARY

In some embodiments, an earth-boring tool includes a tool body, at least one cutting element and a retaining member comprising a shape memory material located between a surface of the tool body and a surface of the at least one cutting element. The shape memory material is configured to transform, responsive to application of a stimulus, from a first solid phase to a second solid phase. The retaining member comprises the shape memory material in the second solid phase, and at least partially retains the at least one cutting element adjacent the tool body.

A method of forming an earth-boring tool includes disposing a retaining member comprising a shape memory material in a space between a cutting element and a tool body and transforming the shape memory material from a first solid phase to a second solid phase by application of a stimulus to create a mechanical interference between the cutting element, the retaining member, and the tool body to secure the cutting element to the tool body.

In other embodiments, a method of forming an earth-boring tool includes training a shape memory material in a first solid phase to a first shape, training the shape memory material in a second solid phase to a second shape such that the retaining member comprising the shape memory material exhibits a dimension larger in at least one direction than in the at least one direction when in the first phase, transforming the shape memory material to the first solid phase, disposing the retaining member comprising the shape memory material in the first solid phase at least partially within the space between a cutting element and a tool body, and transforming the shape memory material to the second solid phase to secure the cutting element to the tool body.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

The illustrations presented herein are not actual views of any particular cutting element, insert, or drill bit, but are merely idealized representations employed to describe example embodiments of the present disclosure. Additionally, elements common between figures may retain the same numerical designation.

As used herein, the term "hard material" means and includes any material having a Knoop hardness value of about 1,000 $Kg_f/mm^2$ (9,807 MPa) or more. Hard materials include, for example, diamond, cubic boron nitride, boron carbide, tungsten carbide, etc.

As used herein, the term "intergranular bond" means and includes any direct atomic bond (e.g., covalent, metallic, etc.) between atoms in adjacent grains of material.

As used herein, the term "polycrystalline hard material" means and includes any material comprising a plurality of grains or crystals of the material that are bonded directly together by intergranular bonds. The crystal structures of the individual grains of polycrystalline hard material may be randomly oriented in space within the polycrystalline hard material.

As used herein, the term "polycrystalline compact" means and includes any structure comprising a polycrystalline hard material comprising intergranular bonds formed by a process that involves application of pressure (e.g., compaction) to the precursor material or materials used to form the polycrystalline hard material.

As used herein, the term "earth-boring tool" means and includes any type of bit or tool used for drilling during the formation or enlargement of a wellbore and includes, for example, rotary drill bits, percussion bits, core bits, eccentric bits, bi-center bits, reamers, mills, drag bits, roller-cone bits, hybrid bits, and other drilling bits and tools known in the art.

Figure 1:
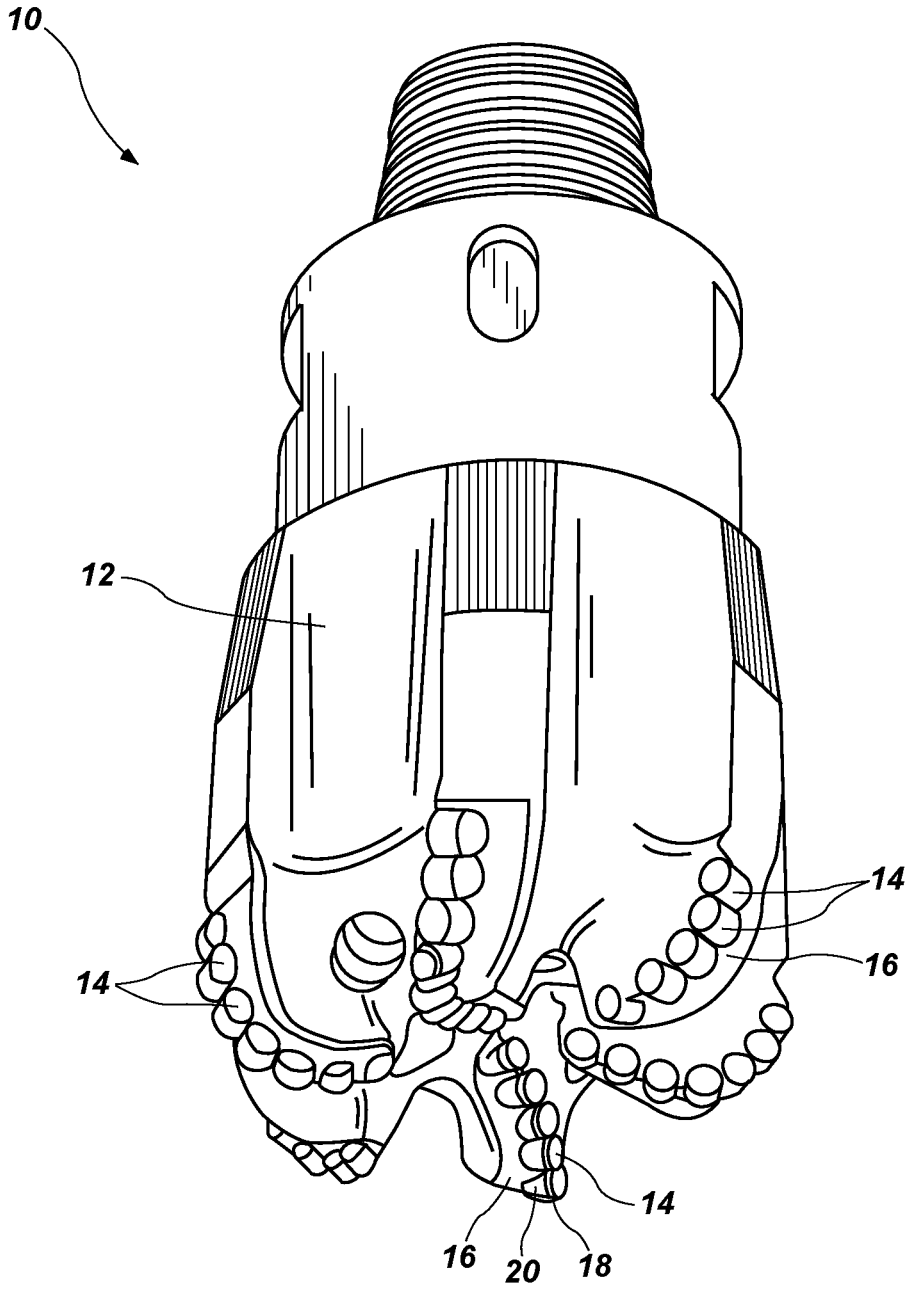
FIG. 1 illustrates an earth-boring rotary drill bit comprising cutting elements secured with shape memory material as described herein.

FIG. 1 illustrates a fixed-cutter earth-boring rotary drill bit 10. The drill bit 10 includes a bit body 12. One or more cutting elements 14 as described herein may be mounted on the bit body 12 of the drill bit 10, such as on blades 16. The cutting elements 14 may optionally be secured within pockets formed in the outer surface of the bit body 12. Other types of earth-boring tools, such as roller cone bits, percussion bits, hybrid bits, reamers, etc., also may include cutting elements 14 as described herein.

The cutting elements 14 may include a polycrystalline hard material 18. Typically, the polycrystalline hard material 18 may include polycrystalline diamond, but may include other hard materials instead of or in addition to polycrystalline diamond. For example, the polycrystalline hard material 18 may include cubic boron nitride. Optionally, cutting elements 14 may also include substrates 20 to which the polycrystalline hard material 18 is bonded, or on which the polycrystalline hard material 18 is formed in an HPHT process. For example, a substrate 20 may include a generally cylindrical body of cobalt-cemented tungsten carbide material, although substrates of different geometries and compositions may also be employed. The polycrystalline hard material 18 may be in the form of a table (i.e., a layer) of polycrystalline hard material 18 on the substrate 20, as shown in FIG. 1. The polycrystalline hard material 18 may be provided on (e.g., formed on or secured to) a surface of the substrate 20. In additional embodiments, the cutting elements 14 may simply be volumes of the polycrystalline hard material 18 having any desirable shape, and may not include any substrate 20. The cutting elements 14 may be referred to as "polycrystalline compacts," or, if the polycrystalline hard material 18 includes diamond, as "polycrystalline diamond compacts."

The polycrystalline hard material 18 may include interspersed and inter-bonded grains forming a three-dimensional network of hard material. Optionally, in some embodiments, the grains of the polycrystalline hard material 18 may have a multimodal (e.g., bi-modal, tri-modal, etc.) grain size distribution.

The drill bit 10 shown in FIG. 1 may include a shape memory material (not shown in FIG. 1) between a surface of the bit body 12 and a surface of one or more of the cutting element 14. The shape memory material may at least partially retain the cutting element 14. In other words, the shape memory material may be used to create mechanical interference between the shape memory material and each of the bit body 12 and the cutting element 14, and the mechanical interference retains the cutting element 14 in position on the bit body 12.

Figure 2A:
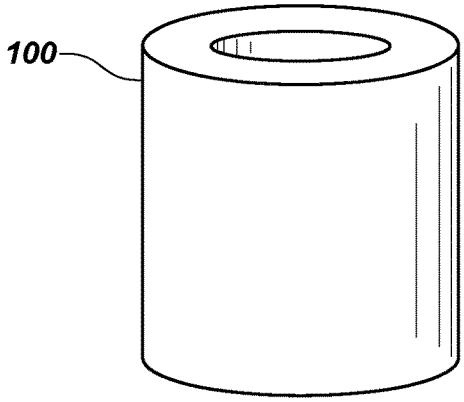
FIG. 2A is a simplified perspective side view of a shape memory material for use in an earth-boring tool.
Figure 2B:
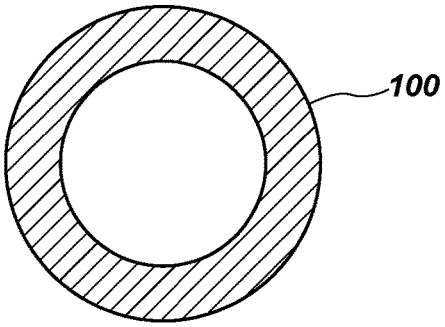
FIG. 2B is a simplified end view of the shape memory material shown in FIG. 2A.

FIG. 2A is a simplified perspective side view of a retaining member 100, which may be used to secure a cutting element 14 (FIG. 1) to a bit body 12 (FIG. 1) of an earth-boring tool. The retaining member 100 may be or include a shape memory material. FIG. 2B is a simplified end view of the retaining member 100 shown in FIG. 2A. As shown in FIGS. 2A and 2B, the retaining member 100 may be in the form of an annular sleeve configured to surround a cutting element 14. In some embodiments, the retaining member 100 may include a metal alloy or a polymer.

The retaining member 100 may include any suitable shape memory material, including shape memory metal alloys and shape memory polymers. Shape memory metal alloys may include Ni-based alloys, Cu-based alloys, Co-based alloys, Fe-based alloys, Ti-based alloys, Al-based alloys, or any mixture thereof. For example, a shape memory metal alloy may include a 50:50 mixture by weight of nickel and titanium, a 55:45 mixture by weight of nickel and titanium, or a 60:40 mixture by weight of nickel and titanium. Many other compositions are possible and can be selected based on tool requirements and material properties as known in the art. Shape memory polymers may include, for example, epoxy polymers, thermoset polymers, thermoplastic polymers, or combinations or mixtures thereof. Other polymers that exhibit shape memory behavior may also be employed. Shape memory materials are polymorphic and may exhibit two or more crystal structures or phases. Shape memory materials may further exhibit a shape memory effect associated with the phase transition between two crystal structures or phases, such as austenite and martensite. The austenitic phase exists at elevated temperatures, while the martensitic phase exists at low temperatures. The shape memory effect may be triggered by a stimulus that may be thermal, electrical, magnetic, or chemical, and which causes a transition from one solid phase to another.

Figure 10A:
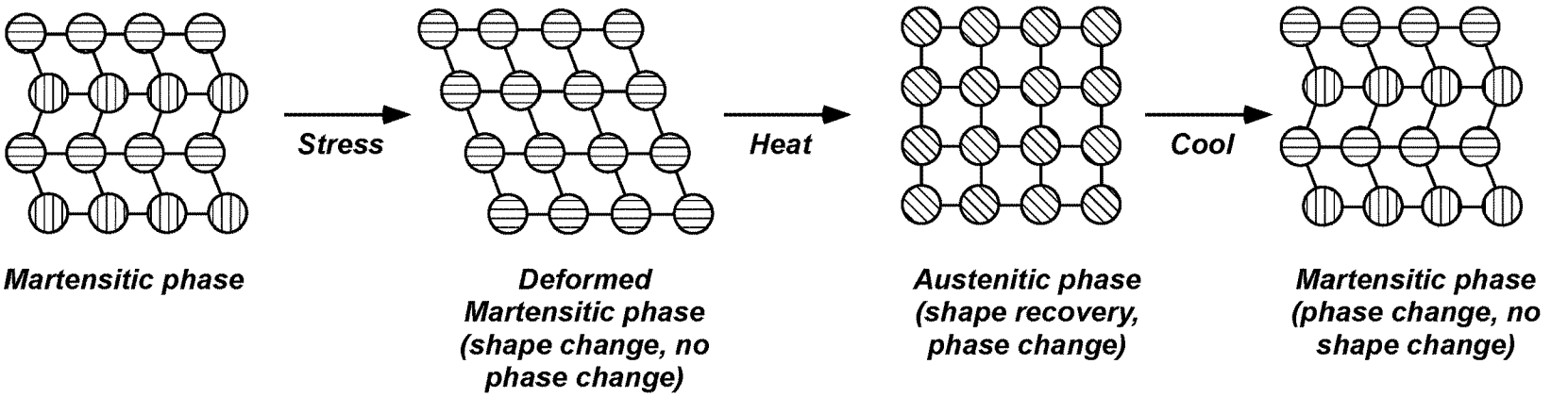
FIGS. 10A and 10B are simplified diagrams illustrating how the microstructure of a shape memory material may change in processes disclosed herein.

By way of non-limiting example, a shape memory alloy may transform from an original austenitic phase (i.e., a high-temperature phase) to a martensitic phase (i.e., a low-temperature phase) upon cooling. The phase transformation from austenite to martensite may be spontaneous, diffusionless, and temperature dependent. The transition temperatures from austenite to martensite and vice versa vary for different shape memory alloy compositions. The phase transformation from austenite to martensite occurs between a first temperature ($M_s$), at which austenite begins to transform to martensite and a second, lower temperature ($M_f$), at which only martensite exists. With reference to FIG. 10A, initially, the crystal structure of martensite is heavily twinned and may be deformed by an applied stress such that the material takes on a new size and/or shape. After the applied stress is removed, the material retains the deformed size and/or shape. However, upon heating, martensite may transform and revert to austenite. The phase transformation occurs between a first temperature ($A_s$) at which martensite begins to transform to austenite and a second, higher temperature ($A_f$) at which only austenite exists. Upon a complete transition to austenite, the element returns to its original "remembered" size and/or shape. As used herein, the term "remembered" refers to a state to which a material returns spontaneously responsive to a temperature change. Upon a second cooling process and transformation from austenite to martensite, the crystal structure of the martensitic phase is heavily twinned and may be deformed by an applied stress such that the material takes on at least one of a new size and/or shape. The size and/or shape of the material in the previously deformed martensitic phase are not remembered from the initial cooling process. This shape memory effect may be referred to as a one-way shape memory effect, such that the element exhibits the shape memory effect only upon heating as illustrated in FIG. 10A.

Figure 10B:
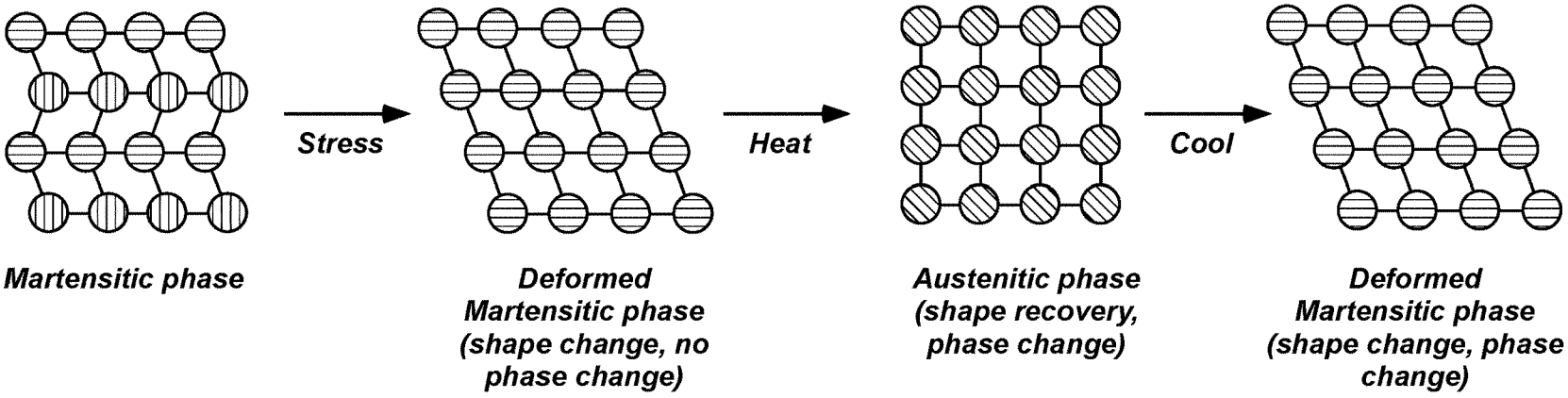

Other shape memory alloys possess two-way shape memory, such that a material comprising such a shape memory alloy exhibits this shape memory effect upon heating and cooling. Shape memory alloys possessing two-way shape memory effect may, therefore, include two remembered sizes and shapes—a martensitic (i.e., low-temperature) shape and an austenitic (i.e., high-temperature) shape. Such a two-way shape memory effect is achieved by "training." By way of example and not limitation, the remembered austenitic and martensitic shapes may be created by inducing non-homogeneous plastic strain in a martensitic or austenitic phase, by aging under an applied stress, or by thermomechanical cycling. With reference to FIG. 10B, when a two-way shape memory alloy is cooled from an austenitic to a martensitic phase, some martensite configurations might be favored, so that the material may tend to adopt a preferred shape. By way of further non-limiting example, and without being bound by any particular theory, the applied stress may create permanent defects, such that the deformed crystal structure of the martensitic phase is remembered. After the applied stress is removed, the element retains the deformed size and/or shape. Upon heating, martensite may transform and revert to austenite between the first temperature ($A_s$) and the second, higher temperature ($A_f$). Upon a complete transition to austenite, the element returns to its original remembered size and shape. The heating and cooling procedures may be repeated such that the material transforms repeatedly between the remembered martensitic and the remembered austenitic shapes.

A shape memory polymer may exhibit a similar shape memory effect. Heating and cooling procedures may be used to transition a shape memory polymer between a hard solid phase and a soft solid phase by heating the polymer above, for example, a melting point or a glass transition temperature ($T_g$) of the shape memory polymer and cooling the polymer below the melting point or glass transition temperature ($T_g$) as taught in, for example, U.S. Pat. No. 6,388,043, issued May 14, 2002, and titled "Shape Memory Polymers," the entire disclosure of which is incorporated herein by this reference. The shape memory effect may be triggered by a stimulus which may be thermal, electrical, magnetic, or chemical.

Though discussed herein as having one or two remembered shapes, shape memory materials may have any number of phases, and may be trained to have a selected remembered shape in any or all of the phases.

The retaining member 100 as shown in FIGS. 2A and 2B may include a shape memory alloy in an austenitic phase. The retaining member 100 may have one or more dimensions that would cause an interference fit between the cutting element 14 and the bit body 12 (FIG. 1). For example, if the cutting element 14 is approximately cylindrical and the retaining member 100 forms an annular sleeve, the inside diameter of the annular sleeve (before the drill bit 10 is assembled) may be slightly smaller than the outside diameter of the cutting element 14. For example, the inside diameter of the retaining member 100 may be from about 0.001 in (0.0254 mm) to about 0.040 in (1.02 mm) smaller than the outside diameter of the cutting element 14, such as from about 0.005 in (0.127 mm) to about 0.010 in (0.254 mm) smaller than the outside diameter of the cutting element 14. In some embodiments, the cutting element 14, the bit body 12, and/or the retaining member 100 may include ridges or other textured surfaces to improve retention or alignment of the cutting element 14 within the bit body 12.

Figure 3A:
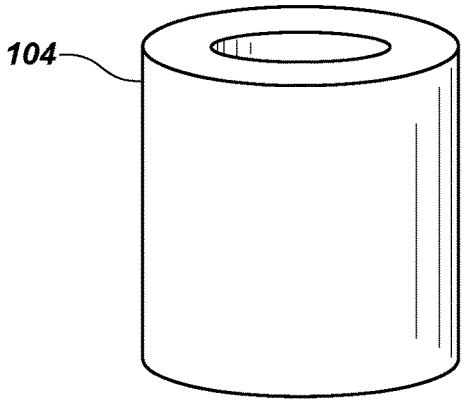
FIG. 3A is a simplified perspective side view of the shape memory material shown in FIG. 2A after a phase transition.
Figure 3B:
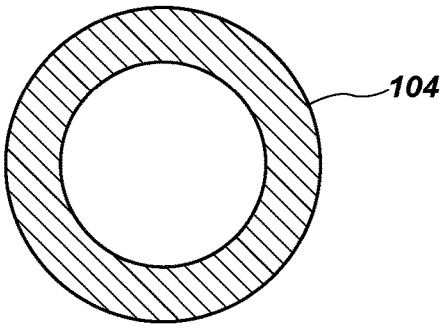
FIG. 3B is a simplified end view of the shape memory material shown in FIG. 3A.

The retaining member 100 may be converted to another solid phase to form the retaining member 104 shown in FIGS. 3A and 3B. The retaining member 104 may have dimensions similar or identical to the dimensions of the retaining member 100 shown in FIGS. 2A and 2B. In some embodiments, the retaining member 104 may include a shape memory alloy in a martensitic phase. The retaining member 100 (FIGS. 2A and 2B) may be converted to the retaining member 104 (FIGS. 3A and 3B) by cooling, such as by cooling below $M_f$ for the material.

Figure 4A:
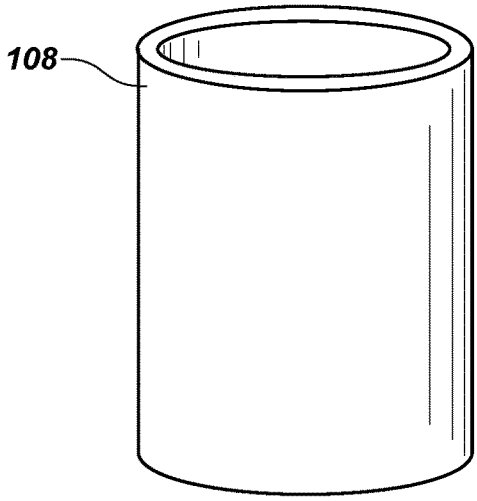
FIG. 4A is a simplified perspective side view of the shape memory material shown in FIG. 3A after training.
Figure 4B:
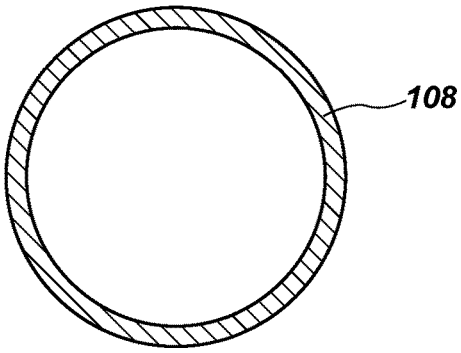
FIG. 4B is a simplified end view of the shape memory material shown in FIG. 4A.

The retaining member 104 may be trained or deformed to form a retaining member 108, shown in FIGS. 4A and 4B, having different dimensions, without changing the phase of the retaining member 104. For example, the retaining member 108 may have a larger inside diameter, a smaller outside diameter, a longer length, or any other selected dimensional difference from the retaining member 104.

Figure 5:
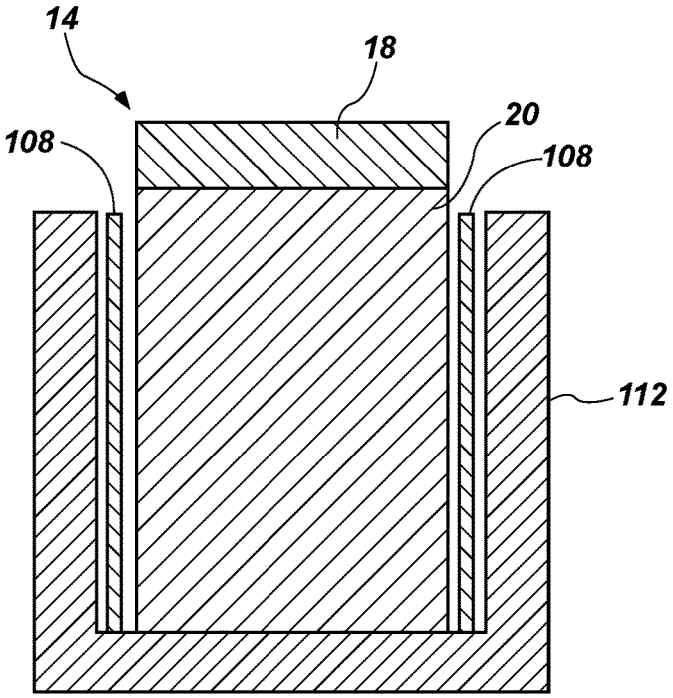
FIG. 5 is a simplified side cutaway view of the shape memory material shown in FIG. 4A in an earth-boring tool.

The retaining member 108 may have dimensions such that the retaining member 108 may be disposed in a cavity adjacent the cutting element 14 and the bit body 12 (FIG. 1). For example, FIG. 5 illustrates that the retaining member 108 may be between an outer surface of the cutting element 14 and an inner surface of a body 112 (which may be, for example, a blade 16 or another portion of the bit body 12). The body 112 may define a pocket shaped generally to fit the cutting element 14 with a thin gap to allow the retaining member 108 to move freely or snugly into and out of the gap. The retaining member 108 may partially or completely surround the cutting element 14. For example, the retaining member 108 may surround the substrate 20.

Figure 6:
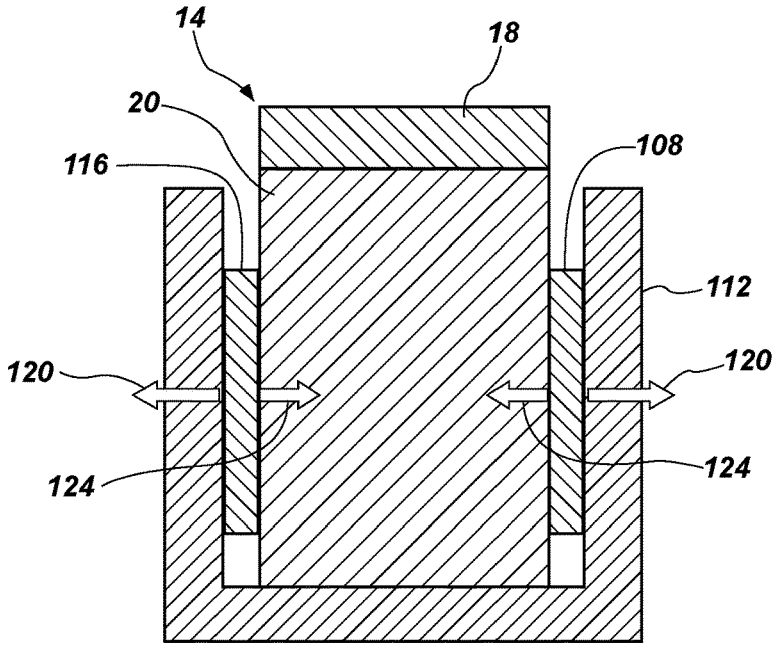
FIG. 6 is a simplified side view of the earth-boring tool shown in FIG. 5 after a phase transition of the shape memory material.

As shown in FIG. 6, after the retaining member 108 is placed adjacent the cutting element 14 and the body 112, the retaining member 108 may be converted to a different solid phase to form a retaining member 116. The retaining member 116 may be a material of the same phase as the material of the retaining member 100 shown in FIGS. 2A and 2B. For example, the retaining member 116 may include a shape memory alloy in an austenitic phase. The conversion may occur due to a stimulus. The stimulus may be a change in temperature (e.g., heating above $A_f$), an electrical current, a magnetic field, or a chemical signal. In some embodiments, an electrical current may pass through the retaining member 108 to cause the retaining member 108 to undergo Joule heating. This heating may raise the temperature of the retaining member 108 above $A_f$ without significantly raising the temperature of the body 112 or the cutting element 14 therein. For example, the cutting element 14 may be maintained at a temperature below about 400° C., below about 300° C., or even below about 200° C. during the phase transition. If the polycrystalline hard material 18 of the cutting element 14 includes diamond, heating of the retaining member 108 may avoid problems associated with overheating the diamond (e.g., back-graphitization, stresses from expansion, etc.) because the temperature at which the phase transition occurs may be lower than temperatures at which diamond tends to degrade.

The retaining member 116 may have approximately the same dimensions as the retaining member 100 shown in FIGS. 2A and 2B, but for the physical constraints on the retaining member 116 based on its location adjacent the body 112 and the cutting element 14. That is, the retaining member 116 may retain its "memory" of the shape it previously had, when in the same phase, as the retaining member 100.

With continued reference to FIG. 6, the retaining member 116 may exert forces 120, 124 on the body 112 and the cutting element 14, respectively. The forces 120, 124 may be exerted based on the tendency of the retaining member 116 to return to the original dimensions of the retaining member 100. The magnitude of the forces 120, 124 may vary based on the dimensions of the retaining member 116 and the magnitude of the deviation from the dimensions of the retaining member 100 in its original state.

Figure 7:
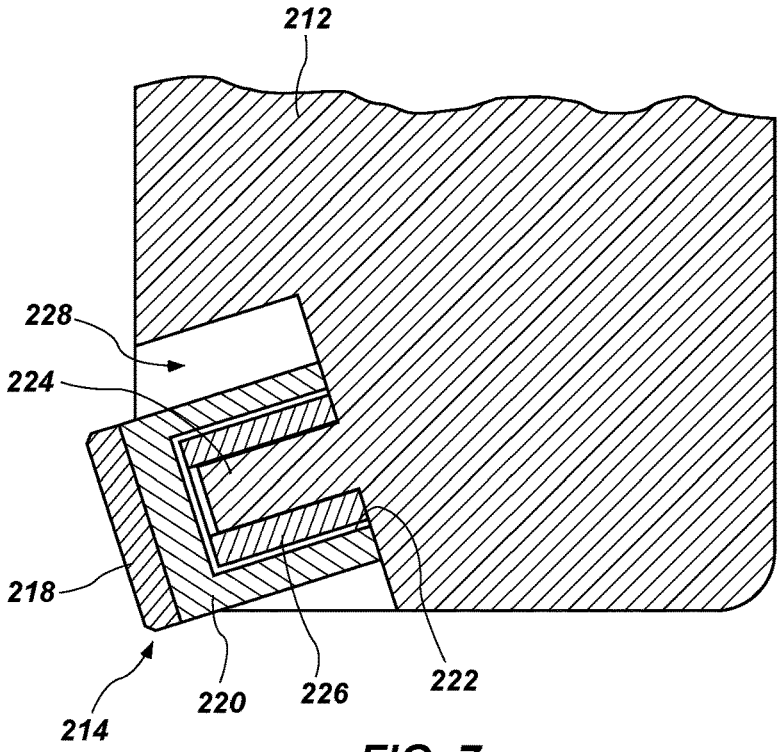
FIGS. 7 and 8 are simplified side cutaway views showing earth-boring tools using shape memory materials to secure cutting elements to a pin on a bit body.

FIG. 7 shows a simplified side cutaway view of another earth-boring tool including a shape memory material. In particular, a bit body 212 may have one or more cutting elements 214 mounted thereon, such as on blades of a fixed-cutter drill bit (e.g., the drill bit 10 shown in FIG. 1). Each cutting element 214 may include a polycrystalline hard material 218, and optionally, a substrate 220, as described previously herein. The substrate 220 may define a cavity 222 therein, which may be used to secure the cutting element 214 to the bit body 212. The bit body 212 may include a pin 224 or other protrusion configured to fit within the cavity 222 in the cutting element 214. A retaining member 226 including a shape memory material may be disposed within the cavity 222 over or around the pin 224. The retaining member 226 may be as described above with respect to FIGS. 2A through 6. That is, the retaining member 226 may include a material that has been trained or deformed in a first solid phase, inserted into the cavity 222 and over the pin 224, and then transformed to a second solid phase having different dimensions. The retaining member 226 may apply a force to retain the cutting element 214 on the bit body 212.

In some embodiments, the pin 224 may have an outside diameter, for example, from about 0.25 in (6.35 mm) to about 0.5 in (12.7 mm). The cavity 222 may have an inside diameter, for example, from about 0.375 in (9.53 mm) to about 0.625 in (15.9 mm). In such embodiments, the retaining member 226 may, when in the phase shown in FIG. 7, have an inside diameter from about 0.25 in (6.35 mm) to about 0.5 in (12.7 mm) and an outside diameter from about 0.375 in (9.53 mm) to about 0.625 in (15.9 mm), such that the retaining member 226 contacts the outside of the pin 224 and the inside of the cavity 222. The retaining member 226 may have a thickness between about 0.005 in (0.13 mm) to about 0.125 in (3.2 mm). In some embodiments, the retaining member 226 may have a thickness less than about 0.030 in (0.76 mm). The size of the pin 224 and cavity 222 may be any size, so long as the substrate 220 can support the forces acting thereon.

In some embodiments, the dimensions of the pin 224, cavity 222, and retaining member 226 may be selected based on the dimensions and materials of the cutting element 214, the dimensions and materials of the bit body 212, the composition of a formation expected to be encountered in drilling operations, or any other factor.

Figure 8:
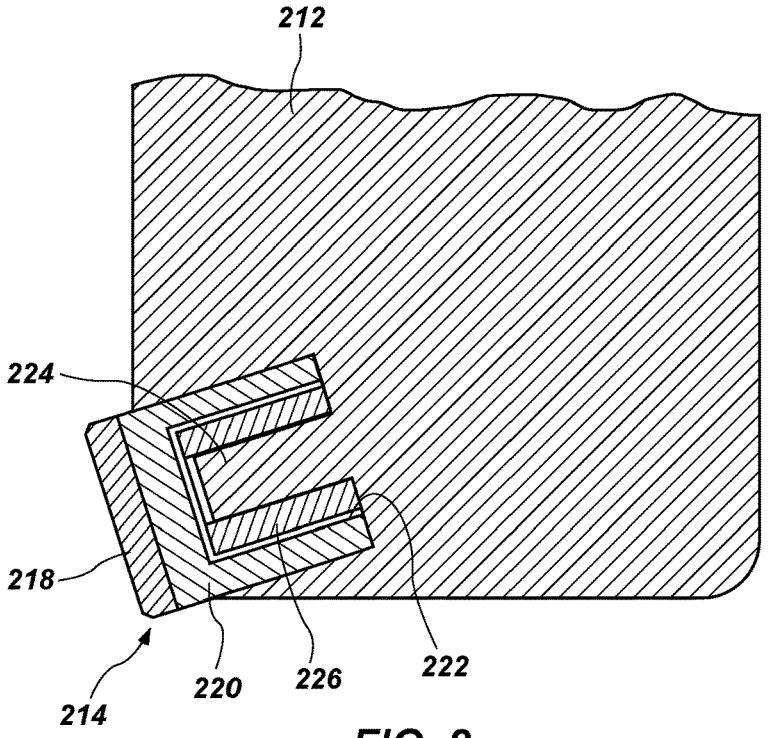

As shown in FIG. 7, there may be a gap 228 between the side of the cutting element 214 (e.g., the outer diameter, if the cutting element 214 is cylindrical) and the bit body 212. That is, the bit body 212 may form a pocket in which the cutting element 214 is disposed, but which does not contact the cutting element 214. In other embodiments, the cutting element 214 may not be in a pocket at all. In other embodiments, and as shown in FIG. 8, the side of the cutting element 214 (e.g., the outer diameter, if the cutting element 214 is cylindrical) may abut the bit body 212 (e.g., in a pocket in the bit body 212). Such a bit body 212 may provide structural support to prevent the portion of the substrate 220 surrounding the pin 224 from deforming due to the outward force of the retaining member 226. When the retaining member 226 expands and pushes outward on the substrate 220, the substrate 220 may be pushed against the surface of the bit body 212.

Figure 9:
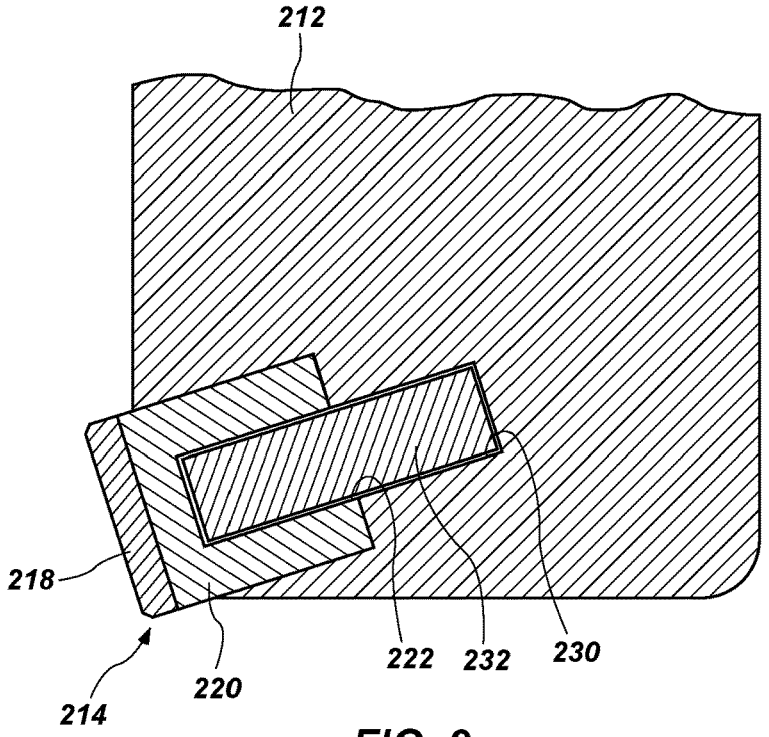
FIG. 9 is a simplified side cutaway view showing an earth-boring tool using a shape memory material as a pin to secure a cutting element to a bit body.

In some embodiments, and as shown in FIG. 9, the bit body 212 may define a cavity 230 into which a pin 232 is inserted. A portion of the pin 232 may also be inserted into the cavity 222 in the cutting element 214. The pin 232 may include a shape memory material, as described herein. Expansion of a dimension of the pin 232 (e.g., a diameter) after a stimulus (e.g., heating) may cause an outward force on both the bit body 212 and the cutting element 214, which may tend to retain the cutting element 214 to the bit body 212. The cavity 230 may be relatively easier to machine than the pin 224 shown in FIGS. 7 and 8, because the cavity 230 may be formed by drilling a hole in the bit body 212. Alternatively, in some embodiments, the cavity 230 may be formed by casting the bit body 212 from a matrix material adjacent a mold.

In some embodiments, the pin 232 may, when in the phase shown in FIG. 9, have an outside diameter, for example, from about 0.315 in (8.0 mm) to about 1.00 in (25.4 mm), such as less than about 0.500 in (12.7 mm). The cavities 222 and 230 may each have an inside diameter matching the outside diameter of the pin 232. In some embodiments, the dimensions of the pin 232 and cavities 222 and 230 may be selected based on the dimensions and materials of the cutting element 214, the dimensions and materials of the bit body 212, the composition of a formation expected to be encountered in drilling operations, or any other factor. The size of the pin 232 and cavities 222 and 230 may be any size, so long as the substrate 220 and bit body 212 can support the forces acting thereon.

Though the pins 224, 232, cavities 222, 230, and retaining member 226 shown in FIG. 7 through 9 are depicted as having generally cylindrical surfaces, these parts may be tapered to allow for easy assembly and disassembly. For example, the interior of the cavities 222, 230 and the exterior of the pins 224, 232 may each have a surface angled from about 0.1° to about 10° from the centerline of the cutting element 214, such as from about 0.5° to about 3°. In some embodiments, interior surfaces of the cavities 222, 230 and exterior surfaces of the pins 224, 232 may have corresponding shapes to aid in retention.

Figure 11:
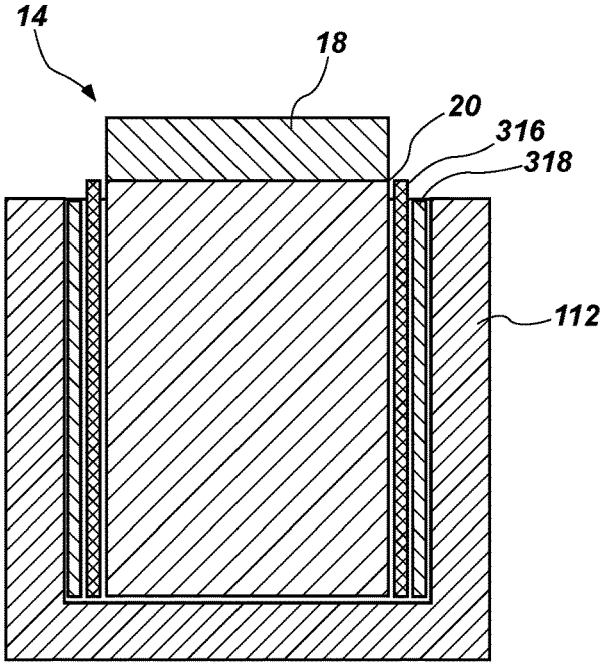
FIGS. 11 and 12 are simplified side cutaway views of an earth-boring tool in which a shape memory material and a filler material are used to secure a cutting element.
Figure 12:
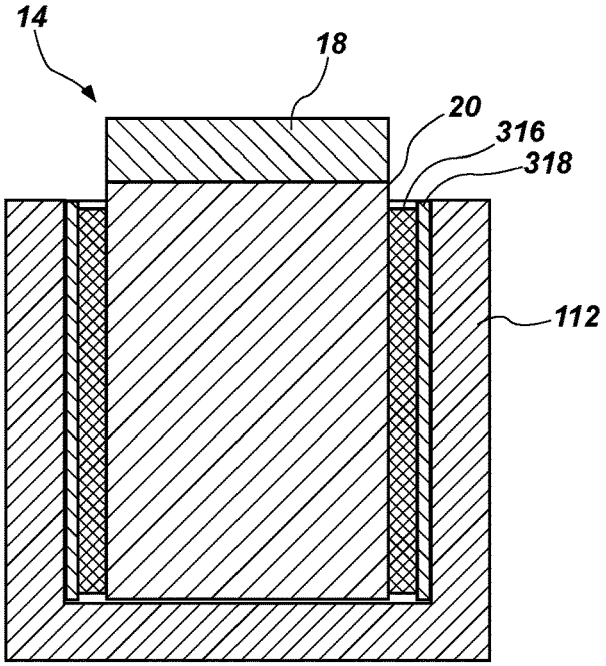

FIGS. 11 and 12 illustrate an embodiment in which a cutting element 14 is secured to a body 112 using a retaining member 316 including a shape memory material and a filler material 318. The filler material 318 may be a material having a melting point below about 300° C., such as a low-temperature alloy. In some embodiments, the filler material 318 may include one or more of metals such as bismuth, antimony, or tin, which may be commercially pure or mixed with other elements. For example, the filler material 318 may include an Sn-based alloy, a Pb-based alloy, an In-based alloy, a Cd-based alloy, a Bi-based alloy, or an Sb-based alloy. The filler material 318 may include a solder material, such as a metal alloy conventionally used to fuse metal objects. In other embodiments, the filler material 318 may include a polymeric material (e.g., an epoxy, a thermoset, etc.). The filler material 318 may be formulated to deform to match the shape of the surfaces of the cutting element 14, the body 112, or the retaining member 316, such as to improve contact between the components. Thus, a filler material 318 may decrease stress concentrations that occur due to surface roughness or a mismatch between shapes of adjacent parts. The use of a filler material 318 may allow parts (including the retaining member 316) to be manufactured with wider tolerance ranges. A filler material 318 may also provide a damping capability to protect the cutting element 14. In some embodiments, the filler material 318 may include more than one type of material, or more than one body, depending on the design of the cutting element 14 and the body 112. Filler materials may also be used in conjunction with other disclosed embodiments, such as those shown in FIGS. 7-9. The filler material 318 may also reduce interface vibration if the filler material has an intermediate acoustic property (i.e., an acoustic property between that of the cutting element 14 and the body 112) to transfer stress waves from a cutting element 14 to the body 112.

The filler material 318 may be disposed adjacent the cutting element 14 and the body 112 in solid or liquid form. For example, the filler material 318 may be inserted as a ring, a sheet, a powder, a paste, or another solid form. In other embodiments, the filler material 318 may be melted, and the molten filler material 318 may be wicked between the cutting element 14 and the body 112.

As discussed above, cutting elements and bit bodies as described may be attached to and/or separated from one another by varying the temperature or providing another stimulus to the shape memory material. Such processes may be performed below decomposition temperatures of the cutting element (typically about 750° C. for polycrystalline diamond cutting elements).

Additional non-limiting example embodiments of the disclosure are described below.

Embodiment 1

An earth-boring tool, comprising a tool body, at least one cutting element, and a retaining member comprising a shape memory material located between a surface of the tool body and a surface of the at least one cutting element. The shape memory material is configured to transform, responsive to application of a stimulus, from a first solid phase to a second solid phase. The retaining member comprises the shape memory material in the second solid phase, and at least partially retains the at least one cutting element adjacent the tool body.

Embodiment 2

The earth-boring tool of Embodiment 1, wherein the at least one cutting element comprises a diamond table secured to a substrate.

Embodiment 3

The earth-boring tool of Embodiment 2, wherein the substrate defines a cavity in which at least a portion of the retaining member is disposed.

Embodiment 4

The earth-boring tool of any of Embodiments 1 through 3, wherein the retaining member comprises at least one annular sleeve.

Embodiment 5

The earth-boring tool of Embodiment 4, wherein the at least one annular sleeve surrounds the at least one cutting element.

Embodiment 6

The earth-boring tool of any of Embodiments 1 through 5, wherein the application of a stimulus comprises heating the shape memory material above a preselected temperature.

Embodiment 7

The earth-boring tool of any of Embodiments 1 through 6, wherein the shape memory material is configured to transform from the second solid phase to the first solid phase to release the at least one cutting element responsive to another stimulus.

Embodiment 8

The earth-boring tool of Embodiment 7, wherein the another stimulus comprises cooling the shape memory material below another preselected temperature.

Embodiment 9

The earth-boring tool of any of Embodiments 1 through 8, wherein the shape memory material comprises an alloy selected from the group consisting of Ni-based alloys, Cu-based alloys, Co-based alloys, Fe-based alloys, Ti-based alloys, Al-based alloys, and mixtures thereof.

Embodiment 10

The earth-boring tool of any of Embodiments 1 through 8, wherein the shape memory material comprises a polymer.

Embodiment 11

The earth-boring tool of any of Embodiments 1 through 10, further comprising a filler material adjacent the retaining member, the filler material configured to at least substantially fill a cavity between the retaining member at least one of the surface of the cutting element and the surface of and the tool body.

Embodiment 12

The earth-boring tool of Embodiment 11, wherein the shape memory material comprises a metal alloy, and wherein the filler material has a melting point less than an austenitic phase transition temperature of the shape memory material.

Embodiment 13

The earth-boring tool of Embodiment 11 or Embodiment 12, wherein the filler material has a melting point less than about 300° C.

Embodiment 14

The earth-boring tool of any of Embodiments 11 through 13, wherein the filler material comprises at least one of Bi, Sb, Sn, an Sn-based alloy, a Pb-based alloy, an In-based alloy, a Cd-based alloy, a Bi-based alloy, or an Sb-based alloy.

Embodiment 15

A method of forming an earth-boring tool, comprising disposing a retaining member comprising a shape memory material in a space between a cutting element and a tool body; and transforming the shape memory material from a first solid phase to a second solid phase by application of a stimulus to cause the retaining member to create a mechanical interference between the cutting element, the retaining member, and the tool body to secure the cutting element to the tool body.

Embodiment 16

The method of Embodiment 15, wherein disposing a retaining member in a space between a cutting element and a tool body comprises disposing the retaining member in a cavity within the cutting element.

Embodiment 17

The method of Embodiment 15 or Embodiment 16, wherein disposing a retaining member in a space between a cutting element and a tool body comprises disposing the retaining member in a cavity within the tool body.

Embodiment 18

The method of any of Embodiments 15 through 17, wherein disposing a retaining member in a space between a cutting element and a tool body comprises disposing at least one annular sleeve in the space.

Embodiment 19

The method of Embodiment 18, wherein disposing at least one annular sleeve in the space comprises disposing the at least one annular sleeve around the cutting element.

Embodiment 20

The method of any of Embodiments 15 through 19, wherein disposing a retaining member in a space between a cutting element and a tool body comprises disposing at least one cylindrical retaining member in the space.

Embodiment 21

The method of any of Embodiments 15 through 20, further comprising applying another stimulus to the shape memory material to release the at least one cutting element from the tool body.

Embodiment 22

The method of Embodiment 21, wherein applying a stimulus to the shape memory material comprises cooling the shape memory material below a preselected temperature.

Embodiment 23

The method of any of Embodiments 15 through 22, further comprising training the shape memory material before disposing the retaining member in the space.

Embodiment 24

The method of any of Embodiments 15 through 23, wherein the stimulus comprises a thermal stimulus.

Embodiment 25

The method of any of Embodiments 15 through 24, wherein the shape memory material comprises an alloy, wherein transforming the shape memory material from a first solid phase to a second solid phase by application of a stimulus comprises converting the alloy from a martensitic phase to an austenitic phase.

Embodiment 26

The method of any of Embodiments 15 through 25, further comprising disposing a filler material adjacent the retaining member prior to transforming the shape memory material from the first solid phase to the second solid phase.

Embodiment 27

A method of forming an earth-boring tool, comprising training a shape memory material in a first solid phase to a first shape, training the shape memory material in a second solid phase to a second shape such that the retaining member comprising the shape memory material exhibits a dimension larger in at least one direction than in the at least one direction when in the first solid phase, transforming the shape memory material to the first solid phase, disposing the retaining member comprising the shape memory material in the first solid phase at least partially within a space between a cutting element and a tool body, and transforming the shape memory material to the second solid phase to secure the cutting element to the tool body.

Embodiment 28

The method of Embodiment 27, wherein disposing the retaining member comprising the shape memory material in the first solid phase at least partially within the space comprises placing the cutting element within a sleeve comprising the shape memory material.

Embodiment 29

The method of Embodiment 27, wherein disposing the retaining member comprising the shape memory material in the first solid phase at least partially within the space comprises disposing the retaining member comprising the shape memory material within each of a first cavity within the cutting element and a second cavity within the tool body.

Embodiment 30

The method of Embodiment 27, further comprising disposing the retaining member around a pin extending from a surface of the tool body.

Embodiment 31

The method of any of Embodiments 27 through 30, wherein transforming the shape memory material to the second solid phase comprises causing the retaining member to apply a force normal to a surface of each of the cutting element and the tool body.

Embodiment 32

The method of any of Embodiments 27 through 31, wherein transforming the shape memory material to the first solid phase comprises cooling the shape memory material.

Embodiment 33

The method of any of Embodiments 27 through 32, wherein transforming the shape memory material to the second solid phase comprises heating the shape memory material.

Embodiment 34

The method of any of Embodiments 27 through 33, further comprising selecting the shape memory material to comprise an alloy selected from the group consisting of Ni-based alloys, Cu-based alloys, Co-based alloys, Fe-based alloys, Ti-based alloys, Al-based alloys, and mixtures thereof.

Embodiment 35

The method of any of Embodiments 27 through 34, further comprising selecting the shape memory material to comprise a polymer.

While the present disclosure may be susceptible to various modifications and alternative forms, specific embodiments have been shown by way of example in the drawings and have been described in detail herein. However, it should be understood that the disclosure is not limited to the particular forms disclosed. Rather, the disclosure includes all modifications, equivalents, legal equivalents, and alternatives falling within the scope of the disclosure as defined by the appended claims. Further, embodiments of the disclosure have utility with different and various tool types and configurations.

What is claimed is:

1. An earth-boring tool, comprising:

a tool body;

at least one cutting element;

a filler material; and a retaining member comprising a shape memory material configured to transform, responsive to application of a stimulus, from a first solid phase to a second solid phase, the retaining member located adjacent the filler material and between a surface of the tool body and a surface of the at least one cutting element, the retaining member comprising the shape memory material in the second solid phase and at least partially retaining the at least one cutting element adjacent the tool body;

wherein the filler material is configured to at least substantially fill an annular cavity between the retaining member and at least one of the surface of the at least one cutting element and the surface of the tool body when the shape memory material is in the first solid phase.

2. The earth-boring tool of claim 1, wherein the retaining member comprises at least one annular sleeve.

3. The earth-boring tool of claim 2, wherein the at least one annular sleeve surrounds the at least one cutting element.

4. The earth-boring tool of claim 1, wherein the shape memory material is configured to transform from the second solid phase to the first solid phase to release the at least one cutting element responsive to another stimulus.

5. The earth-boring tool of claim 1, wherein the filler material comprises at least one material selected from the group consisting of Bi, Sb, Sn, a Sn-based alloy, a Pb-based alloy, an In-based alloy, a Cd-based alloy, a Bi-based alloy, and an Sb-based alloy.

6. The earth-boring tool of claim 1, wherein a first portion of the retaining member is located within a second cavity defined within the at least one cutting element.

7. The earth-boring tool of claim 6, wherein a second portion of the retaining member is located within a third cavity defined within the tool body.

8. A method of forming an earth-boring tool, comprising:

disposing a retaining member comprising a shape memory material in a space between a cutting element and a tool body to form an annular cavity in the space between the retaining member and at least one of a surface of the cutting element and a surface of the tool body;

disposing a filler material adjacent the retaining member to at least substantially fill the annular cavity; and transforming the shape memory material from a first solid phase to a second solid phase by application of a stimulus to cause the retaining member to create a mechanical interference between the cutting element, the retaining member, the filler material, and the tool body to secure the cutting element to the tool body.

9. The method of claim 8, wherein disposing a retaining member in a space between a cutting element and a tool body comprises disposing the retaining member in a cavity within the cutting element.

10. The method of claim 8, wherein disposing a retaining member in a space between a cutting element and a tool body comprises disposing the retaining member in a cavity within the tool body.

11. The method of claim 8, wherein disposing a retaining member in a space between a cutting element and a tool body comprises disposing at least one annular sleeve in the space.

12. The method of claim 11, wherein disposing at least one annular sleeve in the space comprises disposing the at least one annular sleeve around the cutting element.

13. The method of claim 8, wherein disposing a retaining member in a space between a cutting element and a tool body comprises disposing at least one cylindrical retaining member in the space.

14. The method of claim 8, further comprising applying another stimulus to the shape memory material to release the at least one cutting element from the tool body.

15. The method of claim 8, further comprising training the shape memory material before disposing the retaining member in the space.

16. The method of claim 8, wherein transforming the shape memory material from a first solid phase to a second solid phase by application of a stimulus comprises applying a thermal stimulus to the shape memory material.

17. The method of claim 8, wherein the shape memory material comprises an alloy, and wherein transforming the shape memory material from a first solid phase to a second solid phase by application of a stimulus comprises converting the alloy from a martensitic phase to an austenitic phase.

18. The earth-boring tool of claim 8, wherein the cutting element and the tool body define a gap between an exterior surface of the cutting element and a second surface of the tool body.

19. A method of forming an earth-boring tool, comprising:

training a shape memory material in a first solid phase to a first shape;

training the shape memory material in a second solid phase to a second shape such that a retaining member comprising the shape memory material exhibits a dimension larger in at least one direction than in the at least one direction when in the first solid phase;

transforming the shape memory material to the first solid phase;

disposing the retaining member comprising the shape memory material in the first solid phase at least partially within a space between a cutting element and a tool body to form an annular cavity in the space between the retaining member and at least one of a surface of the cutting element and a surface of the tool body;

disposing a filler material adjacent the retaining member to at least substantially fill the annular cavity; and transforming the shape memory material to the second solid phase to secure the cutting element to the tool body.

20. The method of claim 19, wherein transforming the shape memory material to the second solid phase comprises causing the retaining member to apply a force normal to the surface of each of the cutting element and the tool body.

* * * * *